US012330904B2

(12) United States Patent
Sakai

(10) Patent No.: US 12,330,904 B2
(45) Date of Patent: Jun. 17, 2025

(54) MEDIUM CONVEYING APPARATUS TO DETECT MULTI-FEED BASED ON CONTINUOUS OVERLAP PORTION

(71) Applicant: PFU Limited, Kahoku (JP)

(72) Inventor: Masaaki Sakai, Kahoku (JP)

(73) Assignee: PFU LIMITED, Kahoku (JP)

( * ) Notice: Subject to any disclaimer, the term of this patent is extended or adjusted under 35 U.S.C. 154(b) by 13 days.

(21) Appl. No.: 18/379,131

(22) Filed: Oct. 11, 2023

(65) Prior Publication Data

US 2024/0034584 A1 Feb. 1, 2024

Related U.S. Application Data

(63) Continuation of application No. 17/674,775, filed on Feb. 17, 2022, now Pat. No. 11,820,624.

(30) Foreign Application Priority Data

Mar. 4, 2021 (JP) ..... 2021-034620

(51) Int. Cl.
*B65H 7/12* (2006.01)
*B65H 3/06* (2006.01)
*B65H 7/18* (2006.01)

(52) U.S. Cl.
CPC ..... *B65H 7/125* (2013.01); *B65H 3/063* (2013.01); *B65H 7/18* (2013.01); *B65H 2511/13* (2013.01);
(Continued)

(58) Field of Classification Search
CPC . B65H 7/02; B65H 7/12; B65H 7/125; B65H 7/18; B65H 3/063; B65H 2511/13; B65H 2553/30; B65H 2553/82
See application file for complete search history.

(56) References Cited

U.S. PATENT DOCUMENTS 7,654,521 B2 * 2/2010 Simonis ..... B65H 7/20 271/262
11,053,090 B1 * 7/2021 Noviello ..... H04N 1/00039
(Continued)

FOREIGN PATENT DOCUMENTS

JP H07-291485 A 11/1995
JP 2003-160257 A 6/2003
(Continued)

OTHER PUBLICATIONS

Japanese Office Action dated Jul. 16, 2024 regarding Japanese Patent Application No. 2021-034620 corresponding to U.S. Appl. No. 18/379,131 (2 pages) with English Translation (4 pages).

*Primary Examiner* — Prasad V Gokhale
(74) *Attorney, Agent, or Firm* — WOMBLE BOND DICKINSON (US) LLP

(57) ABSTRACT

A medium conveying apparatus includes a conveying roller to convey a medium, an overlap detection sensor, a processor to detect an overlap portion in which it is determined that an overlap has occurred on the medium based on a detection output by the overlap detection sensor for the medium conveyed by the conveying roller, calculate an overlap length where the overlap portion is continuous based on a detection result of the overlap portion, determine whether a multi-feed has occurred based on the overlap length, and execute an abnormal processing for the multi-feed based on a determination result of the multi-feed. The processor determines that a first overlap portion and a second overlap portion are continuous when a distance between the first overlap portion and the second overlap portion is within a predetermined distance in calculating the overlap length.

7 Claims, 9 Drawing Sheets

(52) U.S. Cl.
CPC ..... *B65H 2553/30* (2013.01); *B65H 2553/82* (2013.01)

(56) References Cited

U.S. PATENT DOCUMENTS

| | | | | |
|---|---|---|---|---|
| 2003/0094748 | A1 | 5/2003 | Chujo et al. | |
| 2010/0091344 | A1 | 4/2010 | Simonis et al. | |
| 2011/0278791 | A1* | 11/2011 | Fujii | B65H 7/125<br>271/265.04 |
| 2011/0282487 | A1* | 11/2011 | Niwano | B65H 7/12<br>700/228 |
| 2018/0162665 | A1 | 6/2018 | Fukusaka | |
| 2020/0079608 | A1* | 3/2020 | Hall | H04N 1/00801 |

FOREIGN PATENT DOCUMENTS

| | | | |
|---|---|---|---|
| JP | 2015-147659 | A | 8/2015 |
| JP | 2018-95424 | A | 6/2018 |

* cited by examiner

MEDIUM CONVEYING APPARATUS TO DETECT MULTI-FEED BASED ON CONTINUOUS OVERLAP PORTION

CROSS-REFERENCE TO RELATED APPLICATIONS

This application is a continuation application of U.S. patent application Ser. No. 17/674,775, filed Feb. 17, 2022, which is based upon and claims the benefit of priority of prior Japanese Patent Application No. 2021-034620, filed on Mar. 4, 2021, the entire contents of which are incorporated herein by reference.

TECHNICAL FIELD

Embodiments discussed in the present specification relate to medium conveyance.

BACKGROUND

In general, a medium conveying apparatus such as a scanner has a function of detecting whether or not a multi-feed, that is, a plurality of media being conveyed in an overlapping manner has occurred, and automatically stopping the conveyance of the medium when the multi-feed has occurred.

For example, a multi-feed detecting apparatus to calculate an index indicating a variation based on a set of signal intensities of ultrasonic signals received at a plurality of locations in a conveyed sheet, and determine that the multi-feed of the sheet has occurred when the index is more than a predetermined set value (threshold), is disclosed (Japanese Unexamined Patent Publication (Kokai) No. 2015-147659).

Further, a sheet feeding apparatus including a transmitting means to transmit a signal toward a sheet conveyed by a conveying means, and a receiving means to receive the signal transmitted through the sheet, and output an output signal corresponding to an intensity of the received signal, is disclosed (Japanese Unexamined Patent Publication (Kokai) No. 2018-95424). The sheet feeding apparatus detects the multi-feed of the sheet conveyed by the conveying means according to a predetermined value and a variation range of a plurality of output signals acquired for a single sheet when a type of the sheet loaded on a loading means is a specific type. Further, a multi-feed detection apparatus to prevent an erroneous detection for a document having an adhered object by prohibiting a multi-feed detection in the case where a length for determining the multi-feed is shorter than a predetermined length for each document, is disclosed (Japanese Unexamined Patent Publication (Kokai) No. H07-291485).

SUMMARY

According to some embodiments, a medium conveying apparatus includes a conveying roller to convey a medium, an overlap detection sensor to detect an overlap on the medium conveyed by the conveying roller, a processor to calculate an overlap length over which an overlap is continuous, based on outputs of the overlap detection sensor, determine whether a multi-feed has occurred based on the overlap length, and execute an abnormal processing when multi-feed is determined to have occurred. The overlap detection sensor detects overlaps at a plurality of positions within the medium. In calculating the overlap length, the processor determines that a first overlap portion and a second overlap portion are continuous when a distance between the first overlap portion and the second overlap portion is within a predetermined distance. The first overlap portion and the second overlap portion are portions where the output of the overlap detection sensor detects overlap. The predetermined distance is set to a value larger than a distance between adjacent positions among the plurality of positions at which overlap detection is performed.

According to some embodiments, a method for executing an abnormal processing, conveying a medium, by a conveying roller, detecting an overlap on the medium conveyed by the conveying roller, by an overlap detection sensor, calculating an overlap length over which an overlap is continuous, based on outputs of the overlap detection sensor, determining whether a multi-feed has occurred based on the overlap length, and executing an abnormal processing when multi-feed is determined to have occurred. The overlap detection sensor detects overlaps at a plurality of positions within the medium. In calculating the overlap length, it is determined that a first overlap portion and a second overlap portion are continuous when a distance between the first overlap portion and the second overlap portion is within a predetermined distance. The first overlap portion and the second overlap portion are portions where the output of the overlap detection sensor detects overlap. The predetermined distance is set to a value larger than a distance between adjacent positions among the plurality of positions at which overlap detection is performed.

According to some embodiments, a computer-readable, non-transitory medium stores executable instructions for conveying a medium. The executable instructions include calculating an overlap length over which an overlap is continuous, based on outputs of an overlap detection sensor to detect an overlap on a medium conveyed by a conveying roller, determining whether a multi-feed has occurred based on the overlap length, and executing an abnormal processing when multi-feed is determined to have occurred. The overlap detection sensor detects overlaps at a plurality of positions within the medium. In calculating the overlap length, it is determined that a first overlap portion and a second overlap portion are continuous when a distance between the first overlap portion and the second overlap portion is within a predetermined distance. The first overlap portion and the second overlap portion are portions where the output of the overlap detection sensor detects overlap. The predetermined distance is set to a value larger than a distance between adjacent positions among the plurality of positions at which overlap detection is performed.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method for executing an abnormal processing, and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
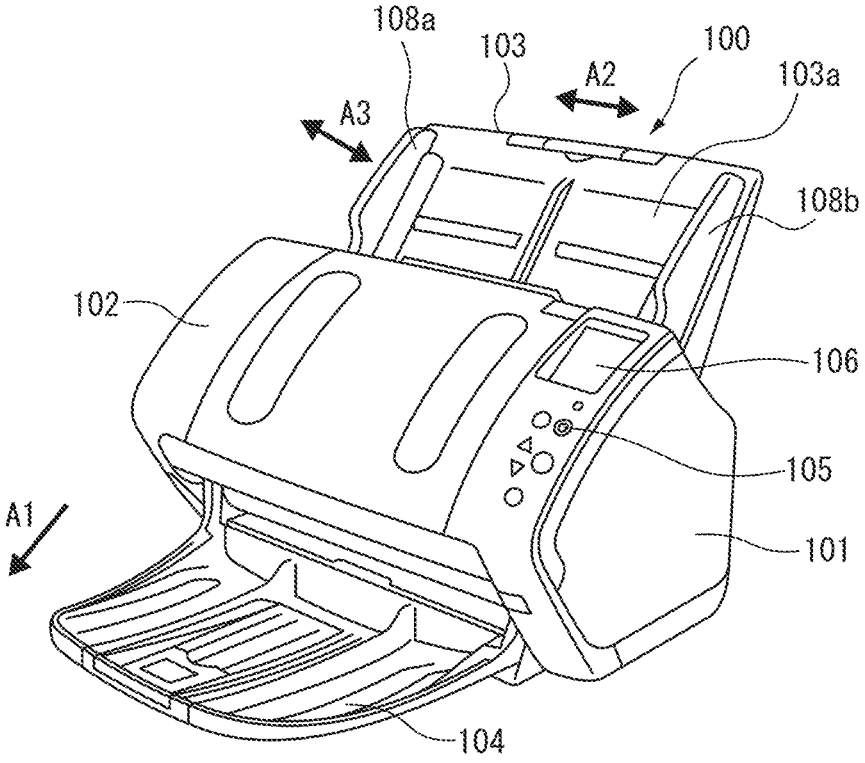
FIG. 1 is a perspective view illustrating a medium conveying apparatus 100 according to a first embodiment.

FIG. 1 is a perspective view illustrating a medium conveying apparatus 100 configured as an image scanner, according to a first embodiment. The medium conveying apparatus 100 conveys and images a medium being a document. The medium is a paper, a card, a booklet, etc. The paper includes thin paper, PPC (Plain Paper Copier) paper, cardboard, etc. The booklet includes a passport or a passbook, etc. The medium also includes a medium having adhered object, such as a label (a seal) or a small size paper piece (a photograph, a cutout, a postage stamp, a revenue stamp, etc.). The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 1 indicates a medium conveying direction. Hereinafter, an upstream refers to an upstream in the medium conveying direction A1, and a downstream refers to a downstream in the medium conveying direction A1.

The medium tray 103 is engaged with the lower housing 101 in such a way as to be able to place a medium to be conveyed. The medium tray 103 has a placing surface 103*a* on which a medium is placed. A first side guide 108*a* and a second side guide 108*b* are provided on the placing surface 103*a*.

The ejection tray 104 is engaged with the upper housing 102 in such a way as to be able to hold an ejected medium. The ejection tray 104 may be engaged with the lower housing 101.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
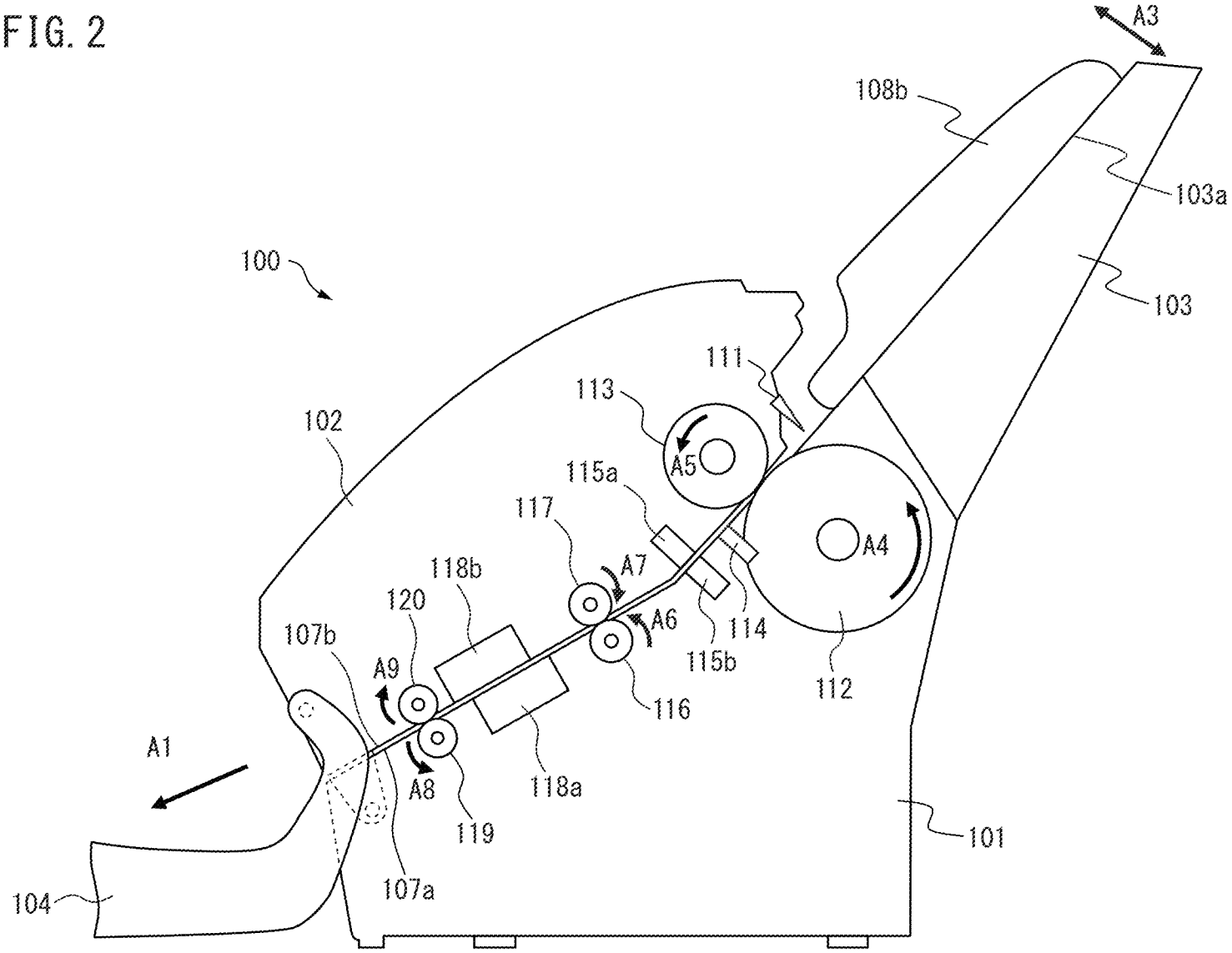
FIG. 2 is a diagram for illustrating a conveyance path inside the medium conveying apparatus 100.

FIG. 2 is a diagram for illustrating a conveyance path inside the medium conveying apparatus 100.

A conveyance path inside the medium conveying apparatus 100, includes a contact sensor 111, a feed roller 112, a brake roller 113, a medium sensor 114, an ultrasonic transmitter 115*a*, an ultrasonic receiver 115*b*, a first conveyance roller 116, a second conveyance roller 117, a first imaging device 118*a*, a second imaging device 118*b*, a third conveyance roller 119 and a fourth conveyance roller 120, etc. The feed roller 112, the brake roller 113, the first conveyance roller 116 and the second conveyance roller 117 are examples of a conveying roller to convey a medium. The number of each roller is not limited to one, and may be plural. Hereinafter, the first imaging device 118*a* and the second imaging device 118*b* may be collectively referred to as imaging devices 118.

The contact sensor 111 is located on the upstream side of the feed roller 112 and the brake roller 113. The contact sensor 111 detects whether or not the medium is placed on the medium tray 103 by the contact detection of the medium. The contact sensor 111 generates and outputs a first medium signal whose signal value changes in a state where the medium is placed on the medium tray 103 and a state where the medium is not placed.

The feed rollers 112 are provided on the lower housing 101 and sequentially feed media placed on the medium tray 103 from the lower side. The brake roller 113 is provided in the upper housing 102 and is located to face the feed roller 112.

The medium sensor 114 is located on the downstream side of the feed roller 112 and the brake roller 113 and on the upstream side of the first conveyance roller 116 and the second conveyance roller 117. In particular, the medium sensor 114 is located between the feed roller 112, and the ultrasonic transmitter 115*a* and the ultrasonic receiver 115*b* in the medium conveying direction A1. The medium sensor 114 detects whether or not the medium exists at the position. The medium sensor 114 includes a light emitter and a light receiver provided on one side with respect to the conveyance path of the medium, and a reflection member such as a mirror provided at a position facing the light emitter and the light receiver with the conveyance path in between (not shown). The light emitter emits light toward the conveyance path. On the other hand, the light receiver receives light projected by the light emitter and reflected by the reflection member, and generates and outputs a second medium signal being an electric signal based on intensity of the received light. Since the light emitted by the light emitter is shielded by the medium when the medium is present at the position of the medium sensor 114, the signal value of the second medium signal is changed in a state where the medium is present at the position of the medium sensor 114 and a state where the medium is not present. The light emitter and the light receiver may be provided at positions facing one another with the conveyance path in between, and the reflection member may be omitted.

The ultrasonic transmitter 115*a* and the ultrasonic receiver 115*b* are located on the downstream side of the feed roller 112 and the brake roller 113 and on the upstream side of the first conveyance roller 116 and the second conveyance roller 117 in the medium conveying direction A1. The ultrasonic transmitter 115*a* and the ultrasonic receiver 115*b* are located close to the conveyance path of a medium in such a way as to face one another with the conveyance path in between. The ultrasonic transmitter 115*a* is capable of outputting an ultrasonic wave. On the other hand, the ultrasonic receiver 115*b* receives an ultrasonic wave being transmitted by the ultrasonic transmitter 115*a* and passing through a medium, and generates and outputs an ultrasonic signal being an electric signal corresponding to the received ultrasonic wave. Hereinafter, the ultrasonic transmitter 115*a* and the ultrasonic receiver 115*b* may be collectively referred to as an ultrasonic sensor 115. The ultrasonic sensor 115 detects the transmission intensity of the ultrasonic wave transmitted through the medium. The ultrasonic sensor 115 is an example of an overlap detection sensor.

The first conveyance roller 116 and the second conveyance roller 117 are located on the downstream side of the feeding roller 112 and the brake roller 113 and on the upstream side of the imaging device 118 in the medium conveying direction A1.

The first imaging device 118*a* is located on the downstream side of the first conveyance roller 116 and the second conveyance roller 117 in the medium conveying direction A1. The first imaging device 118*a* includes a line sensor based on a unity-magnification optical system type contact image sensor (CIS) including an imaging element based on a complementary metal oxide semiconductor (CMOS) linearly located in a main scanning direction. The main scanning direction is a direction perpendicular to the medium conveying direction. The line sensor is an example of an imaging sensor to image a medium. The first imaging device 118*a* includes a light source to irradiate light toward the conveyed medium, a lens for forming an image on the imaging element, and an A/D converter for amplifying and analog-digital (A/D) converting an electric signal output from the imaging element. The first imaging device 118*a* sequentially generates and outputs line images acquired by imaging an area of a front surface of the conveyed medium facing the line sensor at certain intervals. Specifically, a pixel count of a line image in a vertical direction (sub-scanning direction) is 1, and a pixel count in a horizontal direction (main scanning direction) is larger than 1.

Similarly, the second imaging device 118*b* is located on the downstream side of the first conveyance roller 116 and the second conveyance roller 117 in the medium conveying direction A1. The second imaging device 118*b* includes a line sensor based on a unity-magnification optical system type CIS including an imaging element based on a CMOS linearly located in a main scanning direction. The line sensor is an example of an imaging sensor to image a medium. Further, the second imaging device 118*b* includes a light source to irradiate light toward the conveyed medium, a lens for forming an image on the imaging element, and an A/D converter for amplifying and analog-digital (A/D) converting an electric signal output from the imaging element. The second imaging device 118*b* sequentially generates and outputs line images acquired by imaging an area of a back surface of the conveyed medium facing the line sensor at certain intervals.

Only either of the first imaging device 118*a* and the second imaging device 118*b* may be located in the medium conveying apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

A medium placed on the medium tray 103 is conveyed between the lower guide 107*a* and the upper guide 107*b* in the medium conveying direction A1 by the feed roller 112 rotating in a direction of an arrow A4 in FIG. 2. When a medium is conveyed, the brake roller 113 rotates in a direction of an arrow A5. By the workings of the feed roller 112 and the brake roller 113, when a plurality of media are placed on the medium tray 103, only a medium in contact with the feed roller 112, out of the media placed on the medium tray 103, is separated. Consequently, the medium conveying apparatus 100 operates in such a way that conveyance of a medium other than the separated medium is restricted (prevention of multi-feed). The feed roller 112 and the brake roller 113 are an example of a feeding roller to feed by separating the medium placed on the medium tray 103.

The medium is fed between the first conveyance roller 116 and the second conveyance roller 117 while being guided by the lower guide 107*a* and the upper guide 107*b*. The medium is fed between the first imaging device 118*a* and the second imaging device 118*b* by the first conveyance roller 116 and the second conveyance roller 117 rotating in directions of an arrow A6 and an arrow A7, respectively. The medium read by the imaging devices 118 is ejected on the ejection tray 104 by the third conveyance roller 119 and the fourth conveyance roller 120 rotating in directions of an arrow A8 and an arrow A9, respectively.

Figure 3:
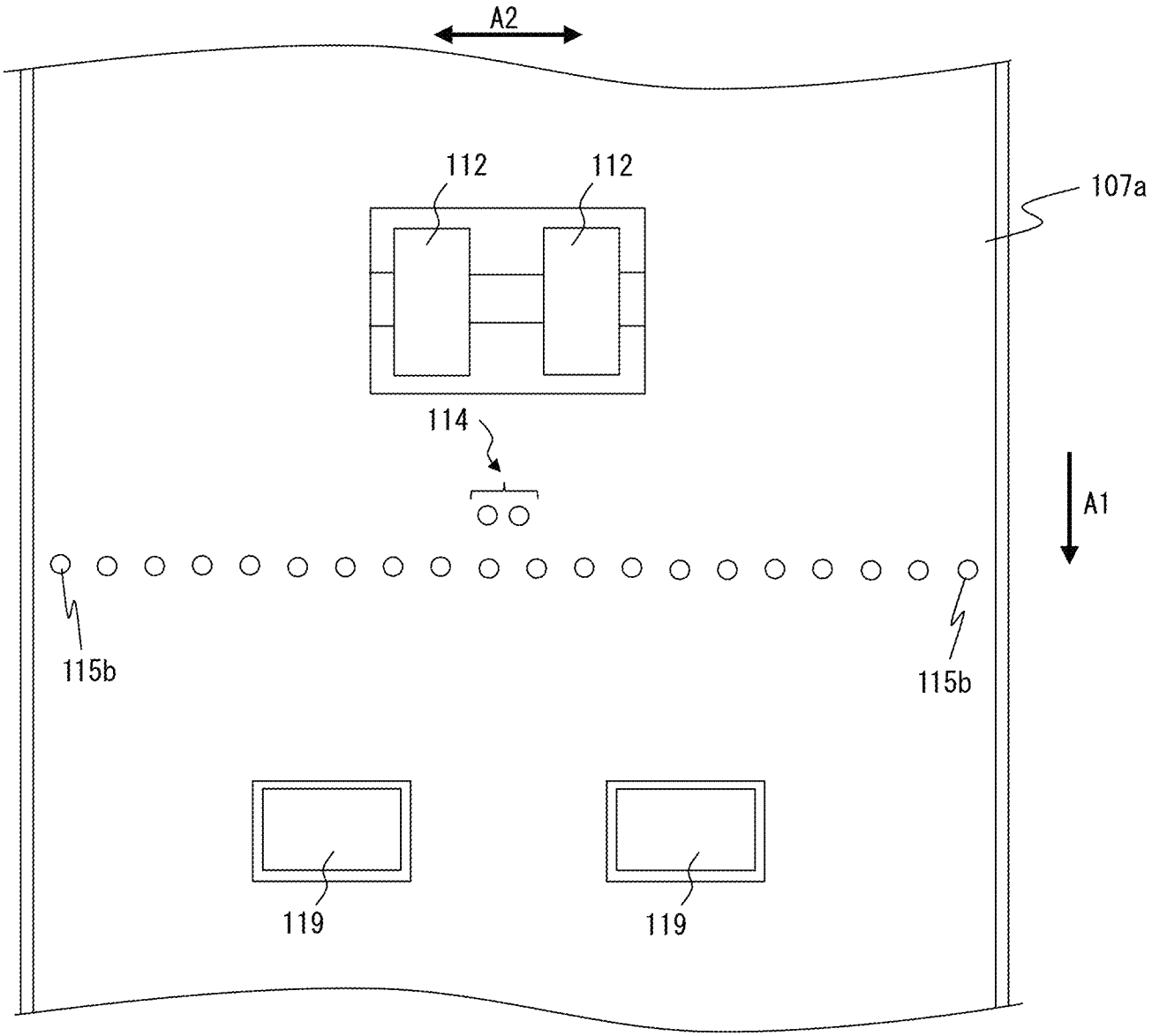
FIG. 3 is a schematic diagram for illustrating an arrangement of an ultrasonic sensor 115, etc.

FIG. 3 is a schematic diagram for illustrating an arrangement of an ultrasonic sensor 115, etc.

FIG. 3 is a schematic diagram of the lower guide 107*a* as viewed from above in a state in which the upper housing 102 is opened. As shown in FIG. 3, a plurality of the ultrasonic sensors 115 are located along the width direction A2 perpendicular to the medium conveying direction. In the example shown in FIG. 3, twenty ultrasonic sensors 115 are located at equal intervals, across both ends of the width direction A2. Thus, the medium conveying apparatus 100 can detect an overlap of the medium at a plurality of positions in the width direction A2. The number of ultrasonic sensors 115 is not limited to 20, and may be 1 to 19, or 21 or more.

The medium sensor 114 is located between the ultrasonic receiver 115*b* and the feed roller 112 in the medium conveying direction A1.

Figure 4:
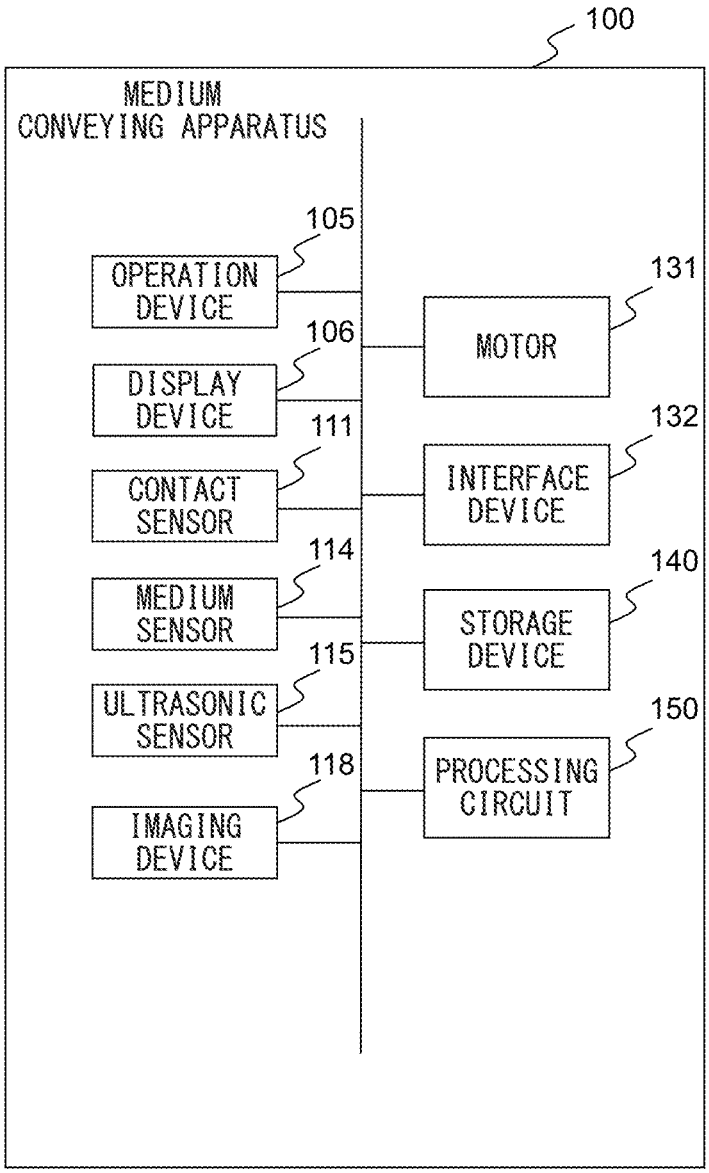
FIG. 4 is a block diagram illustrating a schematic configuration of the medium conveying apparatus 100.

FIG. 4 is a block diagram illustrating a schematic configuration of the medium conveying apparatus 100.

The medium conveying apparatus 100 further includes a motor 131, an interface device 132, a storage device 140, and a processing circuit 150, etc., in addition to the configuration described above.

The motor 131 includes one or more motors to rotate the feed roller 112, the brake roller 113, and the first to fourth conveyance rollers 116, 117, 119 and 120 to convey the medium by a control signal from the processing circuit 150.

For example, the interface device 132 includes an interface circuit conforming to a serial bus such as universal serial bus (USB), is electrically connected to an unillustrated information processing device, and transmits and receives a medium image generated based on the line image and various types of information. Further, a communication device including an antenna transmitting and receiving wireless signals, and a wireless communication interface device for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The storage device 140 stores, as data, arrangement positions of the plurality of ultrasonic sensors 115 in the medium conveyance path, etc.

The processing circuit 150 operates in accordance with a program previously stored in the storage device 140. The processing circuit 150 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operating device 105, the display device 106, the contact sensor 111, the medium sensor 114, the ultrasonic sensor 115, the imaging device 118, the motor 131, the interface device 132 and the storage device 140, etc., and controls each of these units. The processing circuit 150 performs drive control of the motor 131, imaging control of the imaging device 118, etc., generates the medium image, and transmits the medium image to the information processing apparatus via the interface device 132. Further, the processing circuit 150 determines whether or not the multi-feed has occurred based on the ultrasonic signal output by the ultrasonic sensor 115, and executes an abnormal processing for the multi-feed based on the determination result.

Figure 5:
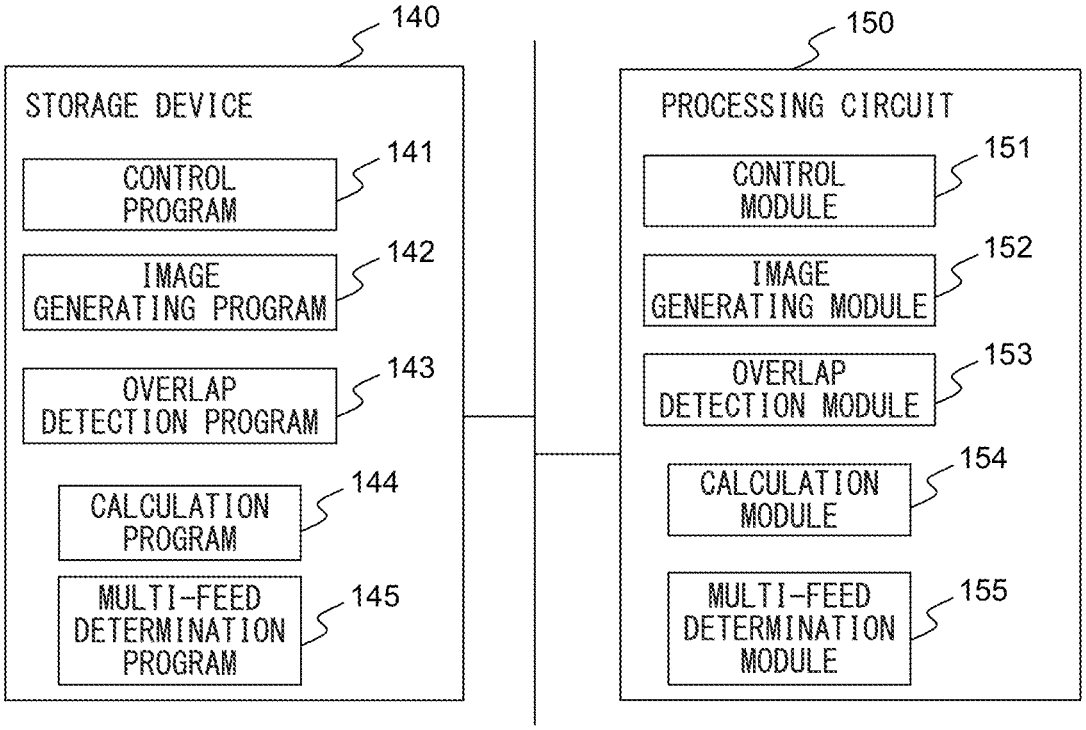
FIG. 5 is a diagram illustrating schematic configurations of the storage device 140 and the processing circuit 150.

FIG. 5 is a diagram illustrating schematic configurations of the storage device 140 and the processing circuit 150.

As shown in FIG. 5, the storage device 140 stores a control program 141, an image generating program 142, an overlap detection program 143, a calculation program 144, a multi-feed determination program 145, etc. Each of these programs is a functional module implemented by software operating on a processor. The processing circuit 150 reads each program stored in the storage device 140 and operates in accordance with each read program. Thus, the processing circuit 150 functions as a control module 151, an image generating module 152, an overlap detection module 153, a calculation module 154, and a multi-feed determination module 155.

Figure 6:
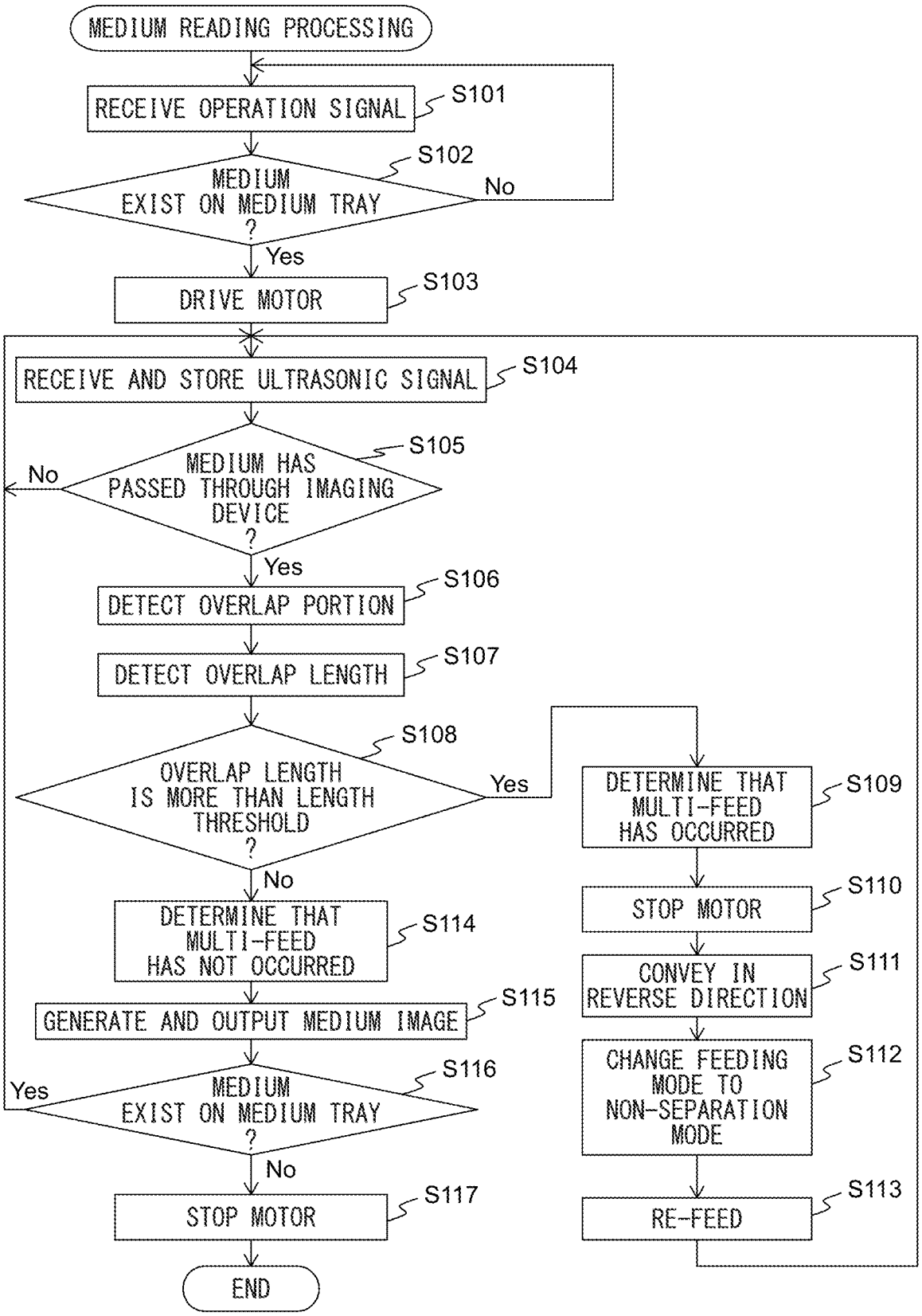
FIG. 6 is a flowchart illustrating an operation example of the medium reading processing.

FIG. 6 is a flowchart illustrating an operation example of medium reading processing in the medium conveying apparatus 100.

Referring to the flowchart illustrated in FIG. 6, an operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140. The operation flow illustrated in FIG. 6 is periodically executed. The medium conveying apparatus 100 has a separation mode for feeding by separating a plurality of media, and a non-separation mode for feeding without separating the medium, as a feeding mode for feeding the medium. The flow of operation shown in FIG. 6 is performed when the feeding mode is set to the separation mode.

First, the control module 151 stands by until an instruction to read a medium is input by a user by use of the operation device 105, and an operation signal instructing to read the medium is received from the operation device 105 (step S101). The operation signal may be fed from the information processing apparatus through the interface device 132 in response to input of a read instruction to the information processing apparatus by a user.

Next, the control module 151 acquires the first medium signal from the contact sensor 111, and determines whether or not a medium is placed on the medium tray 103 based on the acquired first medium signal (step S102).

When a medium is not placed on the medium tray 103, the control module 151 returns the processing to step S101 and stands by until newly receiving an operation signal from the operation device 105.

On the other hand, when the medium is placed on the medium tray 103, the control module 151 drives the motor 131 and rotates the feeding roller 112, the brake roller 113, and the first to fourth conveyance rollers 116, 117, 119, and 120 to convey the medium (step S103). In the separation mode, the control module 151 drives the motor 131 to rotate the feed roller 112 and the first to fourth conveyance rollers 116, 117, 119 and 120 in the directions (the medium feeding direction or the medium conveying direction) of the arrows A4, A6, A7, A8 and A9, respectively. Further, the control module 151 drives the motor 131 to rotate the brake roller 113 in the direction of the arrow A5 (the direction opposite to the medium feeding direction).

Next, the overlap detection module 153 acquires the ultrasonic signal from each ultrasonic sensor 115 and stores the signal value of each ultrasonic signal in the storage device 140 (step S104). The overlap detection module 153 acquires the ultrasonic signal from each ultrasonic sensor 115, each time driving the motor 131 by a predetermined amount set in advance. The medium conveying apparatus 100 can improve the detection accuracy of the multi-feed by setting the predetermined amount to a small value, and can reduce the processing load of the medium reading processing by setting the predetermined amount to a large value. The overlap detection module 153 identifies a position currently facing each ultrasonic sensor 115 in the medium being conveyed based on a driving amount in which the motor 131 is driven from the start of feeding of the medium to the present and an arrangement position of each ultrasonic sensor 115 stored in the storage device 140. The position in the medium conveying direction A1 is calculated based on an conveying amount by the motor 131 and the arrangement position of each ultrasonic sensor 115 in the medium conveying direction A1, and the position of the width direction A2 is calculated based on the position of each ultrasonic sensor 115 outputting each ultrasonic signal in the width direction A2. The overlap detection module 153 stores the signal value of each ultrasonic signal in the storage device 140 in association with the specified position in the medium. The overlap detection module 153 may specify the position currently facing each ultrasonic sensor 115 in the medium being conveyed based on the driving amount in which the motor 131 is driven from the front end of the medium passes through the medium sensor 114 to the present and the arrangement position of each ultrasonic sensor 115 stored in the storage device 140.

Next, the control module 151 determines whether or not the entire medium has passed through the imaging position of the imaging device 118 (step S105). The control module 151, for example, determines whether or not the rear end of the medium has passed through the position of the medium sensor 114 based on the second medium signal received from the medium sensor 114. The control module 151 periodically acquires the second medium signal from the medium sensor 114, and determines that the rear end of the medium has passed through the position of the medium sensor 114 when the signal value of the second medium signal changes from a value indicating that the medium is present to a value indicating that there is no medium. The control module 151 determines that the rear end of the medium has passed through the imaging position of the imaging device 118 and the entire medium has been imaged when a predetermined time has elapsed since the rear end of the medium passes through the position of the medium sensor 114. The control module 151 may determine the entire conveyed medium has been imaged when a predetermined time has elapsed since the start of feeding of the medium. When the entire medium has not yet passed through the imaging position (step S105—No), the control module 151 returns the process to step S104.

On the other hand, when the entire medium passes through the imaging position (step S105—Yes), the overlap detection module 153 reads the signal value of each ultrasonic signal from the storage device 140, detects the overlap portion of the medium based on the signal value of the read ultrasonic signal (step S106). The overlap portion is a portion in which it is determined that an overlap has occurred on the medium.

The overlap detection module 153 detects the overlap portion based on a detection output by the ultrasonic sensor 115 for the medium conveyed by the conveying roller. The overlap detection module 153 detects the overlap portion by comparing the transmission intensity detected by the ultrasonic sensor 115 with the overlap threshold. The overlap detection module 153 detects each position in the medium stored in association with the ultrasonic signal whose signal value is less than the overlap threshold, as the overlap portion. On the other hand, the overlap detection module 153 determines that the overlap has not occurred for each position in the medium stored in association with the ultrasonic signal whose signal value is equal to or more than the overlap threshold. The overlap threshold is set to a value between the signal value of the ultrasonic signal when a single medium is conveyed and the signal value of the ultrasonic signal when the overlap of the medium has occurred. Thus, the overlap detection module 153 can accurately identify the position where the overlap has occurred in the medium.

Further, the overlap detection module 153 detects the overlap portion based on each ultrasonic signal acquired each time driving the motor 131 by a predetermined amount. In other words, the overlap detection module 153 detects whether or not the overlap portion exists at a predetermined cycle. Thus, the overlap detection module 153 can accurately detect the multi-feed of the medium while suppressing an increase in the processing load of the medium reading processing.

Figure 7A:
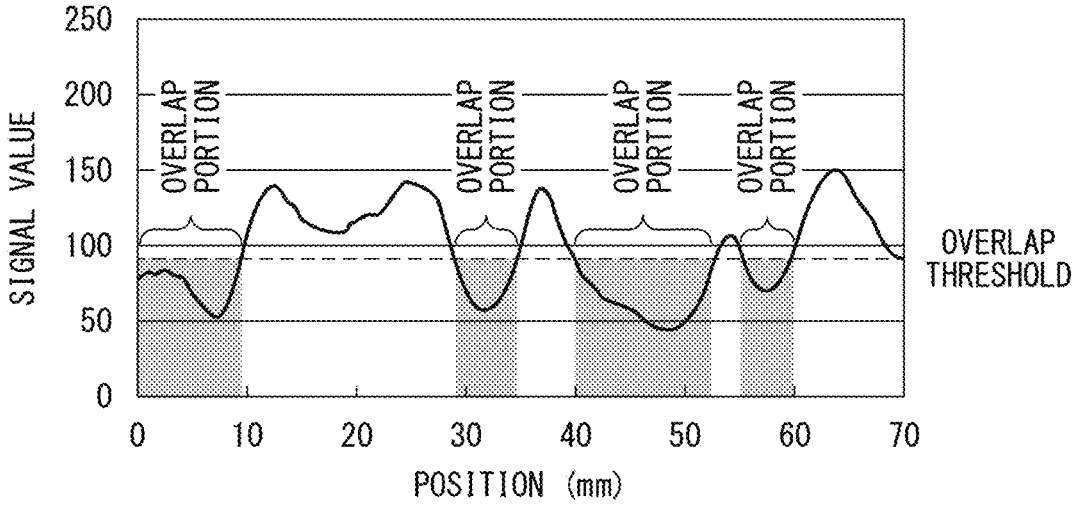
FIG. 7A is a graph representing a relationship between a signal value of an ultrasonic signal and a position on a medium.

FIG. 7A is a graph representing a relationship between the signal value of the ultrasonic signal and the position on the medium.

The vertical axis of FIG. 7A indicates the signal value of the ultrasonic signal, and the horizontal axis indicates the position in the medium conveying direction A1. The graph shown in FIG. 7A indicates the signal value of the ultrasonic signal output when the thin paper is conveyed in the multi-feed manner. As shown in FIG. 7A, the intensity of the ultrasonic wave transmitted through the thin paper varies due to the unevenness of fibers in the thin paper. Even when a normal paper such as PPC paper is conveyed in the multi-feed manner, the intensity of the ultrasonic wave transmitted through two papers varies due to variations in a distance (thickness of air) between the two papers. Therefore, a region detected as the overlap portion in the medium, and a region not detected as the overlap portion are mixed.

Next, the calculation module 154 calculates an overlap length based on the detection result of the overlap portion (step S107).

The calculation module 154 calculates the overlap length along the medium conveying direction A1. In other words, the calculation module 154 calculates, for each position in the medium facing each ultrasonic sensor 115 in the width direction A2, a length where the overlap portion is continuous in the medium conveying direction A1, as the overlap length. However, the calculation module 154 determines two overlap portions are continuous when a distance between the two overlap portions is equal to or less than a reference distance, even when there is a position at which it is determined that the overlap has not occurred, between the two overlap portions in the medium conveying direction A1. In other words, the calculation module 154 determines that a first overlap portion and a second overlap portion are continuous when a distance between the first overlap portion and the second overlap portion is equal to or less than the reference distance. The reference distance is appropriately set based on a thickness or a hardness of a medium (thin paper) supported by the medium conveying apparatus 100. The reference distance is, for example, set to the maximum length of a region where the overlap of the medium is not detected continuously in a prior experiment in which two sheets of thin paper are conveyed in the overlapped manner to detect the overlap portion.

Figure 7B:
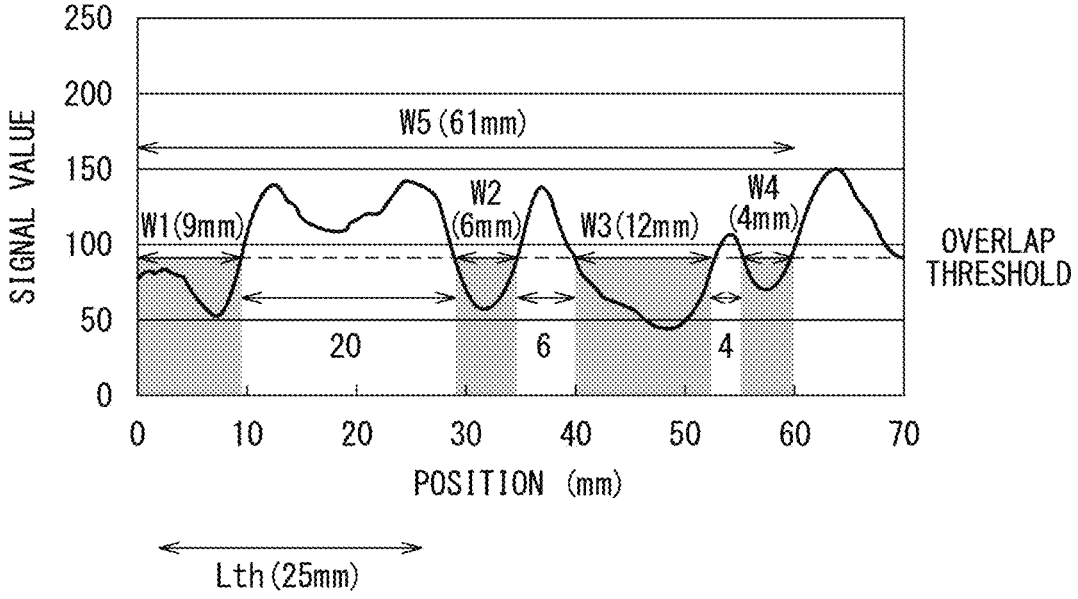
FIG. 7B is a graph for illustrating an overlap length.

FIG. 7B is a graph for illustrating the overlap length.

FIG. 7B is a graph similar to the graph shown in FIG. 7A. In the example shown in FIG. 7B, the overlap portion is continuous in a first region W1, a second region W2, a third region W3 and a fourth region W4. There are regions (respectively having a length of 20 mm, 6 mm, 4 mm) where it is determined that the overlap has not occurred, between the first region W1 and the second region W2, between the second region W2 and the third region W3, and between the third region W3 and the fourth region W4. For example, when the reference distance Lth is set to 25 mm, it is determined that the first region W1, the second region W2, the third region W3 and the fourth region W4 are continuous, a length (61 mm) of a region W5 from the front end of the first region W1 to the rear end of the fourth region W4 is calculated as the overlap length.

Next, the multi-feed determination module 155 determines whether or not the overlap length calculated by the calculation module 154 is equal to or more than a length threshold (in S108 of steps). The length threshold is, for example, set to a value (e.g., 20 mm) between a size of an adhered object such as a photograph adhered to a general resume or a postage stamp and a size of the minimum medium supported by the medium conveying apparatus 100. Thus, the multi-feed determination module 155 can appropriately determine whether or not the medium to which the adhered object is adhered is conveyed or the multi-feed of the medium has occurred.

When at least one of the overlap lengths calculated by the calculation module 154 is equal to or more than the length threshold (step S108—Yes), the multi-feed determination module 155 determines that the multi-feed of the medium has occurred (step S109).

In the example shown in FIG. 7A and FIG. 7B, the maximum length where the overlap portion is actually continuous in the medium conveying direction A1 is 12 mm in the region W3. Therefore, if the length threshold in the medium conveying direction A1 is 20 mm, when it is not determined that the overlap portions where the interval is equal to or less than the reference distance are continuous, it is determined that the multi-feed of the medium has not occurred.

On the other hand, the calculation module 154 determines that the first region W1, the second region W2, the third region W3 and the fourth region W4 are continuous, and calculates a length (61 mm) of the region W5 from the front end of the first region W1 to the rear end of the fourth region W4, as the overlap length. Therefore, the overlap length is equal to or more than the length threshold, and it is determined that the multi-feed of the medium has occurred. Thus, the medium conveying apparatus 100 can correctly determine that the multi-feed of the medium has occurred even when the multi-feed of the medium in which the intensity of the ultrasonic wave transmitted varies in each position.

When it is determined that the multi-feed of the medium has occurred, the control module 151 stops the motor 131 to stop feeding and conveying the medium, as an abnormal processing for the multi-feed (step S110). The control module 151 can suppress damage to the medium, by stopping the feeding and the conveying of the medium when the multi-feed of the medium has occurred. Further, the control module 151 notifies the user of a warning by displaying information indicating that the multi-feed has occurred on the display device 106 or transmitting the information to the information processing device via the interface device 132, as the abnormal processing for the multi-feed. Thus, the control module 151 executes the abnormal processing for the multi-feed, based on the determination result of the multi-feed.

Next, the control module 151 drives the motor 131 to rotate the feed roller 112 and the first to fourth conveyance rollers 116, 117, 119 and 120 in the directions opposite to the arrows A4, A6, A7, A8 and A9 (the medium feeding direction or the medium conveying direction), respectively. Further, the control module 151 drives the motor 131 to rotate the brake roller 113 in the direction of the arrow A5 (the direction opposite to the medium feeding direction). Thus, the control module 151 conveys the medium in reverse direction, and once returns the medium to the medium tray 103 (step S111).

Next, the control module 151 changes the feeding mode from the separation mode to the non-separation mode (step S112). In the non-separation mode, the control module 151 rotates the feed roller 112 and the first to fourth conveyance rollers 116, 117, 119 and 120 in the directions (the medium feeding direction or the medium conveying direction) of the arrows A4, A6, A7, A8 and A9, respectively. Further, in the non-separation mode, the control module 151 shuts off the driving force from the motor 131 to the brake roller 113 to turn off the separation function for the medium to be fed. The control module 151 may turn off the separation function for the medium to be fed by rotating the brake roller 113 in the medium feeding direction (the direction opposite to the arrow A5) or by reducing the separation force by the brake roller 113.

Next, the control module 151 re-drives the motor 131 and re-rotates the feeding roller 112 and the first to fourth conveyance rollers 116, 117, 119, and 120 in the medium feeding direction or the medium conveying direction to re-feed and re-convey the medium (step S113). Next, the control module 151 proceeds the process to step S104. At this time, the brake roller 113 is driven by the feed roller 112 or rotates in the medium feeding direction by the motor 131 so as not to separate the medium.

Thus, after the control module 151 stops the feeding of the medium as the abnormal processing, the control module 151 controls the feed roller 112 and the brake roller 113 to once return the medium to the medium tray 103 and re-feed the medium without separating the medium. Consequently, a user does not need to re-feed the media by turning off the separation function of the medium, and the control module 151 can improve the convenience of the user. Incidentally, the processes of steps S108 and S110 may be omitted, and the control module 151 may only execute changing the feed mode while stopping feeding and conveying the medium. In that case, the user does not need to change the feeding mode, the control module 151 can improve the convenience of the user.

On the other hand, when all the overlap lengths calculated by the calculation module 154 are less than the length threshold (step S108—No), the multi-feed determination module 155 determines that the multi-feed of the medium has not occurred (step S114).

In this way, the multi-feed determination module 155 determines whether or not the multi-feed of the medium has occurred based on the overlap length calculated by the calculation module 154. In particular, the multi-feed determination module 155 determines that the multi-feed of the medium has occurred when the maximum value of each overlap length calculated by the calculation module 154 is equal to or more than the length threshold, and it determines that the multi-feed of the medium has not occurred when the maximum value is less than the length threshold. The multi-feed determination module 155 may determine whether or not the multi-feed of the medium has occurred based on a statistical value other than the maximum value of each overlap length. The statistical value other than the maximum value is, for example, the average value, the minimum value or the median value. The multi-feed determination module 155 may determine that the multi-feed of the medium has occurred when the statistical value of each overlap length is equal to or more than the length threshold, and it may determine that the multi-feed of the medium has not occurred when the statistical value is less than the length threshold. In other words, the multi-feed determination module 155 determines whether or not the multi-feed has occurred based on the average value, the maximum value, the minimum value or the median value of the plurality of overlap lengths when the plurality of overlap lengths are calculated. Thus, the multi-feed determination module 155 can determine whether or not the multi-feed has occurred with higher accuracy.

Next, the image generating module 152 reads out each line image generated during conveying the medium from the storage device 140, synthesizes all the acquired line images to generate a medium image, and transmits the medium image to the information processing apparatus via the interface device 132 (step S115).

Next, the control module 151 determines whether or not the medium remains on the medium tray 103 based on the first medium signal acquired from the contact sensor 111 (step S116). When a medium remains on the medium tray 103, the control module 151 returns the process to step S104 and repeats the processes in steps S104 to S116.

On the other hand, when a medium does not remain on the medium tray 103, the control module 151 stops the motor 131 to stop conveying the medium (step S117), and ends the series of steps.

The processes of step S111 to S113 are omitted, the control module 151 may end the series of steps without executing the re-feeding of the medium when the control module 151 stops the feeding and the conveying of the medium.

Further, the processing circuit 150 may execute the processes of steps S106 to S113, rather than after the entire medium has passed through the imaging position of the imaging device 118, at predetermined intervals (each time driving the motor 131 by a predetermined amount). In that case, the multi-feed determination module 155 determines that the multi-feed of the medium has not occurred, when the overlap length is less than the length threshold until the entire medium passes through the imaging position of the imaging device 118.

Further, in step S107, the calculation module 154 may calculate the overlap length along the width direction A2 perpendicular to the medium conveying direction or both the medium conveying direction A1 and the width direction A2 perpendicular to the medium conveying direction.

When the overlap length is calculated along the width direction A2, the calculation module 154 calculates a length where the overlap portions are continuous in the width direction A2 as the overlap length, for each position facing each ultrasonic sensor 115 at the timing of acquiring the ultrasonic signal in the medium conveying direction A1 in the medium. However, the calculation module 154 determines two overlap portions are continuous when a distance between the two overlap portions is equal to or less than a reference distance, even when there is a position at which it is determined that the overlap has not occurred, between the two overlap portions in the width direction A2. In other words, the calculation module 154 determines that a first overlap portion and a second overlap portion are continuous when a distance between the first overlap portion and the second overlap portion is equal to or less than the reference distance. When calculating the overlap length along the width direction A2, the reference distance may be set to a value different from the reference distance when calculating the overlap length along the medium conveying direction A1.

In this case, in step S108, the multi-feed determination module 155 determines whether or not the multi-feed of the medium has occurred by determining whether or not the overlap length along the width direction A2 is equal to or more than the length threshold. The length threshold compared with the overlap length along the width direction A2 may be set to a value different from the length threshold compared with the overlap length along the medium conveying direction A1.

Alternatively, the multi-feed determination module 155 determines whether or not the multi-feed of the medium has occurred by determining whether or not the overlap length along the medium conveying direction A1 and the overlap length along the width direction A2 are equal to or more than the length threshold. In that case, the multi-feed determination module 155 determines that the multi-feed of the medium has occurred when either of the overlap length along the medium conveying direction A1 and the overlap length along the width direction A2 is equal to or more than the length threshold, and it determines that the multi-feed of the medium has not occurred when both of the overlap lengths are less than the length threshold. The multi-feed determination module 155 may determine that the multi-feed of the medium has occurred when both the overlap length along the medium conveying direction A1 and the overlap length along the width direction A2 are equal to or more than the length threshold, and it may determine that the multi-feed of the medium has not occurred when either of the overlap lengths is less than the length threshold. The multi-feed determination module 155 can determine whether or not the multi-feed has occurred with higher accuracy, by using the overlap length along both the medium conveying direction A1 and the width direction A2.

In this case, the multi-feed determination module 155 may also determine whether or not multi-feed of the medium has occurred based on whether or not the statistical value such as the average value, the maximum value, the minimum value or the median value of each overlap length is equal to or more than the length threshold.

Figure 8A:
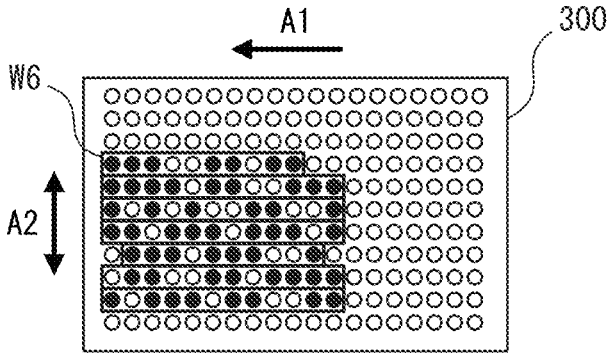
FIG. 8A is a schematic diagram for illustrating the overlap length along a medium conveying direction A1
Figure 8B:
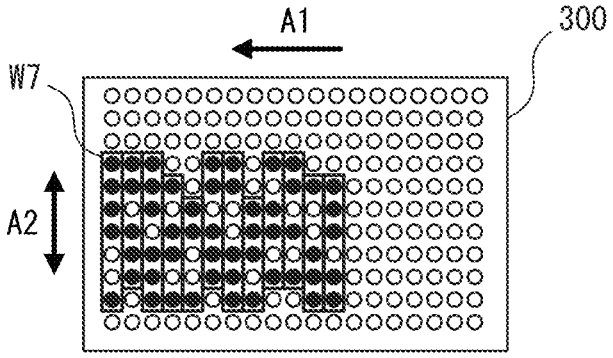
FIG. 8B is a schematic diagram for illustrating the overlap length along a width direction A2.
Figure 8C:
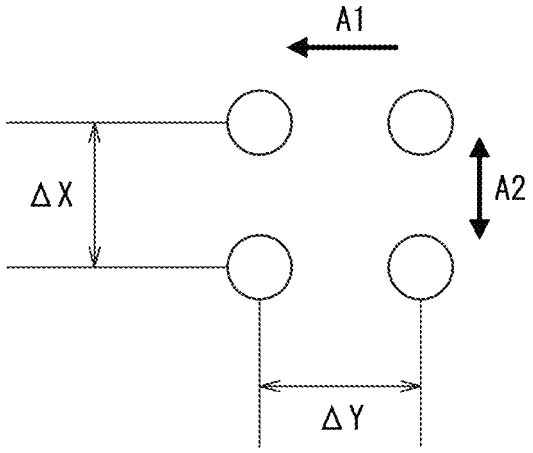
FIG. 8C is a schematic diagram for illustrating a distance between respective regions in the medium facing an ultrasonic sensor 115 when the ultrasonic signal is acquired.

FIG. 8A is a schematic view for illustrating the overlap length along the medium conveying direction A1, and FIG. 8B is a schematic view for illustrating the overlap length along the width direction A2. FIG. 8C is a schematic diagram for illustrating a distance between regions respectively facing the ultrasonic sensors 115 when acquiring the ultrasonic signal in the medium.

FIG. 8A, FIG. 8B and FIG. 8C illustrate a medium 300 conveyed by the medium conveying apparatus 100. The regions facing the ultrasonic sensors 115 when acquiring the ultrasonic signal in the medium 300 are represented by circles, the overlap portion of the regions are represented by black circles, regions where it is determined that the overlap has not occurred are represented by white circles. In the example shown in FIG. 8A and FIG. 8B, as shown in FIG. 8C, the ultrasonic sensors 115 are located every interval $\Delta X$ in the width direction A2, and the ultrasonic signals are acquired every interval $\Delta Y$ in the medium conveying direction A1.

In the example shown in FIGS. 8A and 8B, the maximum continuous number of overlap portions adjacent to each other in the medium conveying direction A1 is 4, and the length thereof is $3\Delta Y$. Further, the maximum continuous number of overlap portions adjacent to each other in the width direction A2 is 4, and the length thereof is $3\Delta X$. Therefore, if the length threshold in the medium conveying direction A1 is $4\Delta Y$ and the length threshold in the width direction A2 is $4\Delta X$, when it is not determined that the overlap portions where the interval is equal to or less than the reference distance are continuous, it is determined that the multi-feed of the medium has not occurred.

On the other hand, when the reference distance in the medium conveying direction A1 is $3\Delta Y$ and the reference distance in the width direction A2 is $3\Delta X$, the overlap length in the medium conveying direction A1 is $11\Delta Y$, and the overlap length in the width direction A2 is $6\Delta X$. Therefore, it is determined that the multi-feed of the medium has occurred. Thus, the medium conveying apparatus 100 can correctly determine that the multi-feed of the medium has occurred even when the multi-feed of the medium in which the intensity of the ultrasonic wave transmitted varies in each position.

As described in detail above, the medium conveying apparatus 100 according to the embodiment determines whether or not the multi-feed has occurred based on the overlap length where the overlap portion is continuous.

Thus, the medium conveying apparatus 100 can more accurately determine whether or not the multi-feed of the medium has occurred.

In general, a medium conveying apparatus may erroneously determine that the multi-feed has occurred when the medium to which a small adhered object is adhered is conveyed. The medium conveying apparatus 100 determines whether or not the multi-feed of the medium has occurred based on the length of the area where the overlap has occurred in the medium. Thus, the medium conveying apparatus 100 can suppress erroneously determining that the multi-feed has occurred when the medium to which a small adhered object is adhered is conveyed. Further, the medium conveying apparatus 100 determines that a plurality of overlap portions are continuous when a distance between the plurality of overlap portions is within a predetermined distance. Thus, the medium conveying apparatus 100 can detect the multi-feed of the medium in which the intensity of the ultrasonic wave transmitted varies in each position, with high accuracy. In particular, since the medium conveying apparatus 100 can calculate the length of the area where the overlap occurs in the medium by a simple calculation, it can reduce the processing load and the memory usage of the medium read processing.

In the above-described embodiment, although the ultrasonic sensor to output the transmission information of the ultrasonic wave is used as the overlap detection sensor, the thickness sensor to detect thickness information of the medium may be used as the overlap detection sensor. The thickness sensor is located at a position where each ultrasonic sensor 115 is located. The thickness sensor includes a light emitter and a light receiver located close to the conveyance path of the medium in such a way as to face one another with the conveyance path in between. The light emitter emits light (infrared light or visible light) toward the light receiver. On the other hand, the light receiver receives the light emitted by the light emitter, and generates and outputs a thickness signal being an electric signal corresponding to the intensity of the received light. When a medium exists at the position of the thickness sensor, the light emitted by the light emitter is attenuated by the medium, and the greater the thickness of the medium, the greater the amount of attenuation. For example, the thickness sensor generates the thickness signal such that the greater the thickness of the medium, the greater the signal value.

A reflected light sensor, a pressure sensor or a mechanical sensor may be used as the thickness sensor. The reflected light sensor includes a pair of light emitter and light receiver provided on one side with respect to a conveyance path of the medium and a pair of light emitter and light receiver provided on the other side. The reflected light sensor detects a distance between each pair and each surface of the medium, based on a time from when one pair emits light to one surface of the medium to when it receives the reflected light and a time from when the other pair emits light to the other surface of the medium to when it receives the reflected light. The reflected light sensor generates a thickness signal which indicates a subtracted value acquired by subtracting each detected distance from a distance between the two pairs, as the thickness information. The pressure sensor detects a pressure which changes according to the thickness of the medium, and generates a thickness signal which indicates the detected pressure, as the thickness information. The mechanical sensor detects a movement amount of a roller in contact with the medium, and generates a thickness signal which indicates the detected movement amount, as the thickness information.

When the thickness sensor is used as the overlap detection sensor, in step S104 of FIG. 6, the overlap detection module 153 acquires the thickness signal from each thickness sensor, instead of the ultrasonic signal, and stores it in the storage device 140 in association with the position in the medium. Further, in step S106, the overlap detection module 153 reads the signal value of each thickness signal from the storage device 140 and detects the respective position in the medium stored in association with the thickness signal whose signal value is equal to or more than the overlap threshold as the overlap portion.

Further, in the above-described embodiment, although the feed roller 112 is located on the lower side of the brake roller 113 and feeds the medium placed on the medium tray 103 sequentially from the lower side, the feed roller may be located on the upper side of the brake roller so as to feed the medium placed on the medium tray sequentially from the upper side.

Figure 9:
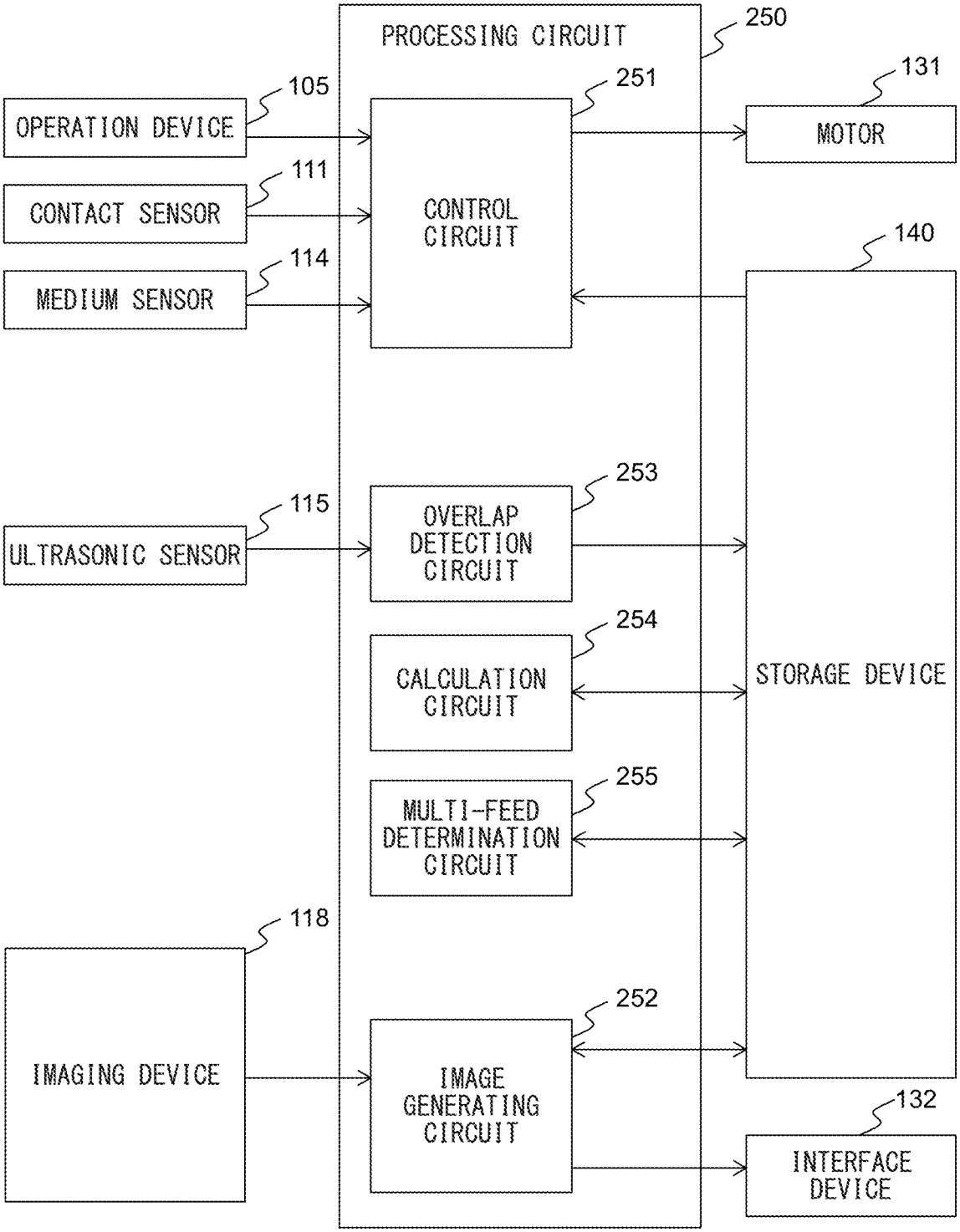
FIG. 9 is a diagram illustrating a schematic configuration of another processing circuit 250.

FIG. 9 is a diagram illustrating a schematic configuration of another processing circuit 250. The processing circuit 250 is used in place of the processing circuit 150 of the medium conveying apparatus 100, and executes the medium reading processing, the overlap detection processing, the overlap length calculation processing, the multi-feed determination processing, and the control processing instead of the processing circuit 150. The processing circuit 250 includes a control circuit 251, an image generating circuit 252, an overlap detection circuit 253, a calculation circuit 254, a multi-feed determination circuit 255, etc. Note that each unit may be configured by an independent integrated circuit, a microprocessor, firmware, etc.

The control circuit 251 is an example of a control module, and has a function similar to the control module 151. The control circuit 251 receives the operation signal from the operation device 105, the first medium signal from the contact sensor 111, and the second medium signal from the medium sensor 114, respectively, and reads the medium image from the storage device 140. The control circuit 251 outputs a control signal to the motor 131 so as to control the feeding and conveying of the medium in response to each information received or read. Further, the control circuit 251 reads the determination result of the multi-feed from the storage device 140, and executes the abnormal processing for the multi-feed based on the read determination result.

The image generating circuit 252 is an example of an image generating module, and has a function similar to the image generating module 152. The image generating circuit 252 receives the line image from the imaging device 118 and stores it in the storage device 140, generates the medium image, and transmits it to the information processing apparatus via the interface device 132.

The overlap detection circuit 253 is an example of an overlap detection module, and has a function similar to the overlap detection module 153. The overlap detection circuit 253 detects the overlap portion based on the ultrasonic signal from the ultrasonic sensor 115, and stores the detection result in the storage device 140.

The calculation circuit 254 is an example of a calculation module, and has a function similar to the calculation module 154. The calculation circuit 254 reads the detection result of the overlap portion from the storage device 140, calculates the overlap length based on the read detection result, and stores it in the storage device 140.

The multi-feed determination circuit 255 is an example of the multi-feed determination module, and has a function similar to the multi-feed determination module 155. The multi-feed determination circuit 255 reads the overlap length from the storage device 140, determines whether or not the multi-feed has occurred based on the overlap length, and stores the determination result in the storage device 140.

As described in detail above, the medium conveying apparatus can more accurately determine whether or not the multi-feed of the medium has occurred, even when using the processing circuit 250.

According to the embodiment, the medium conveying apparatus, the method, and the computer-readable, non-transitory medium storing the control program, can more accurately determine whether or not the multi-feed of the medium has occurred.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a conveying roller to convey a medium;

an overlap detection sensor to detect an overlap on the medium conveyed by the conveying roller;

a processor to calculate an overlap length over which the overlap is continuous, based on outputs of the overlap detection sensor, determine whether a multi-feed has occurred based on the overlap length, and execute an abnormal processing when multi-feed is determined to have occurred, wherein the overlap detection sensor detects overlaps at a plurality of positions within the medium, wherein in calculating the overlap length, the processor determines that a first overlap portion and a second overlap portion are continuous when a distance between the first overlap portion and the second overlap portion is within a predetermined distance, wherein the first overlap portion and the second overlap portion are portions where the output of the overlap detection sensor detects overlap, and wherein the predetermined distance is set to a value larger than a distance between adjacent positions among the plurality of positions at which overlap detection is performed.

2. The medium conveying apparatus according to claim 1, wherein the processor calculates each overlap length along a medium conveying direction, a direction perpendicular to the medium conveying direction, or both the medium conveying direction and the direction perpendicular to the medium conveying direction.

3. The medium conveying apparatus according to claim 1, wherein the overlap detection sensor is an ultrasonic sensor to detect a transmission intensity of an ultrasonic wave transmitted through the medium, and the processor determines whether the output of the overlap detection sensor indicates overlap by comparing the transmission intensity detected by the overlap detection sensor with a predetermined threshold.

4. The medium conveying apparatus according to claim 1, wherein a plurality of the overlap detection sensors are located along a direction perpendicular to a medium conveying direction.

5. The medium conveying apparatus according to claim 1, wherein the processor determines whether the overlap portion exists, at a predetermined cycle.

6. A method for executing an abnormal processing in a medium conveying apparatus, comprising:

conveying a medium, by a conveying roller;

detecting an overlap on the medium conveyed by the conveying roller, by an overlap detection sensor;

calculating an overlap length over which an overlap is continuous, based on outputs of the overlap detection sensor;

determining whether a multi-feed has occurred based on the overlap length; and executing an abnormal processing when multi-feed is determined to have occurred, wherein the overlap detection sensor detects overlaps at a plurality of positions within the medium, in calculating the overlap length, it is determined that a first overlap portion and a second overlap portion are continuous when a distance between the first overlap portion and the second overlap portion is within a predetermined distance, wherein the first overlap portion and the second overlap portion are portions where the output of the overlap detection sensor detects overlap, and the predetermined distance is set to a value larger than a distance between adjacent positions among the plurality of positions at which overlap detection is performed.

7. A computer-readable, non-transitory medium storing executable instructions for conveying a medium in a medium conveying apparatus, the executable instructions comprising:

calculating an overlap length over which an overlap is continuous, based on outputs of an overlap detection sensor to detect an overlap on a medium conveyed by a conveying roller;

determining whether a multi-feed has occurred based on the overlap length; and executing an abnormal processing when multi-feed is determined to have occurred, wherein the overlap detection sensor detects overlaps at a plurality of positions within the medium, in calculating the overlap length, it is determined that a first overlap portion and a second overlap portion are continuous when a distance between the first overlap portion and the second overlap portion is within a predetermined distance, wherein the first overlap portion and the second overlap portion are portions where the output of the overlap detection sensor detects overlap, and the predetermined distance is set to a value larger than a distance between adjacent positions among the plurality of positions at which overlap detection is performed.

* * * * *